United States Patent [19]

Haines

[11] 4,422,223

[45] Dec. 27, 1983

[54] FIXED CLOTH SPEED INSPECTION MACHINE

[76] Inventor: Robert L. Haines, 17 Wolf Ave., Reisterstown, Md. 21136

[21] Appl. No.: 174,467

[22] Filed: Aug. 1, 1980

[51] Int. Cl.[3] ..... D06H 3/04

[52] U.S. Cl. ..... 26/70; 242/67.4; 242/75.51

[58] Field of Search ..... 26/70; 242/75.51; 33/132 A; 242/67.4; 356/238

[56] References Cited

U.S. PATENT DOCUMENTS

| | | | |
|---|---|---|---|
| 2,205,630 | 6/1940 | Remington | 26/70 |
| 2,219,701 | 10/1940 | Remington | 26/70 |
| 2,323,741 | 7/1943 | Watson . | |
| 2,470,575 | 5/1949 | Norton . | |
| 2,583,674 | 1/1952 | Tobler, Jr. | 26/70 |
| 2,771,251 | 11/1956 | Silverstein | 26/70 X |
| 2,777,964 | 1/1957 | Di Mino | 242/75.51 X |
| 2,936,506 | 5/1960 | Butler, Jr. et al. . | |
| 2,989,264 | 6/1961 | King . | |
| 3,030,689 | 4/1962 | Mays | 26/70 |
| 3,223,906 | 12/1965 | Dinger . | |
| 3,348,107 | 10/1967 | Hamby | 242/75.51 X |
| 3,409,762 | 11/1968 | O'Brien et al. | 26/70 UX |
| 3,589,578 | 6/1971 | Kamphausen | 26/70 X |
| 3,910,521 | 10/1975 | O'Callaghan et al. . | |
| 3,927,844 | 12/1975 | Bond et al. . | |
| 3,942,735 | 3/1976 | Marchio et al. . | |

FOREIGN PATENT DOCUMENTS

| | | | |
|---|---|---|---|
| 666226 | 6/1979 | U.S.S.R. | 26/70 |

*Primary Examiner*—Robert Mackey

*Attorney, Agent, or Firm*—Leitner, Palan, Martin & Bernstein

[57] ABSTRACT

Manual speed adjusted cloth inspection machines are converted to fixed cloth speed machines by replacing the transmission and variable ratio pulley and belt drive system with a cloth speed responsive tachometer controlling the speed of a motor to drive the reel mount at a constant speed through a fixed ratio pulley and belt drive system. Conveniently located start, stop and reversing switches are provided as well as end of roll speed control.

16 Claims, 7 Drawing Figures

FIXED CLOTH SPEED INSPECTION MACHINE

BACKGROUND OF THE INVENTION

The present invention related generally to cloth inspection machines and more specifically to a method of modifying cloth inspection machines to insure constant linear cloth speed.

Cloth inspection machines have ranged from the simple structure of U.S. Pat. Nos. 2,936,506 and 3,942,735 with no speed control to the speed control structure of U.S. Pat. Nos. 2,470,575 and 3,927,844. In U.S. Pat. No. 2,470,575 to Norton a mechanical lever detects the diameter of the material on the roll and provides adjustment of the mechanical speed changing device interconnecting the drive motor and the take-up reel. U.S. Pat. No. 3,927,844 to Bond et al. also includes a lever which is responsive to the diameter of a material being let off and adjusts a potentiometer which varies the speed of the motor. Without any speed control, the linear speed of the cloth could vary between 10 yards per minute at the beginning to 45 yards per minute at the end of the roll.

Both of the automatic motor speed changing inspection station devices by using a material rolled diameter measurement provides a crude speed adjustment. The linear speed of the material is kept certain limits which could not be considered substantially constant. Similarly, there are many applications wherein it is undesirable to have a roller or any other device in contact with the material. Thus it would be impossible to mechanically monitor the diameter of the roll. Similarly, the mechanical speed changing device of the Norton patent is very hard on the drive belts and consequently continuously needs replacement.

A typical cloth and inspection machine used throughout the industry is illustrated in FIGS. 1 and 2 as a Measurematic available from Cutting Room Appliances, New York, N.Y. The machine includes manual controls at the right side of the machine including a two-speed transmission for forward, reverse, and neutral as well as two speeds and a variable speed pulley and belt transmission controlled by a foot pedal to further vary the speed between the two speeds of the transmission. As with the Norton patent, the variable ratio pulleys and belt drive system are undesirable since they destroy a lot of belts. Also, the transmission slips with usage. Another limitation of this machine is that by placing the controls to one side of the inspection machine, the operators will position themselves close to the controls and will not detect flaws in the material for large width cloths.

As is well known, the speed of the inspection machine varies with the diameter of the material on the take-up reel. These machines require the operator to change the speed using the transmission as well as the variable speed changing foot pedal. Operators are generally lazy and will ignore the foot pedal speed change. Therefore, they will run it at substantially higher speeds than necessary which increases the error rate of detecting flaws.

Thus, there is a need in the industry for a cloth inspection station where the linear speed of the cloth is automatically controlled. Also, because of the large investment of various companies in cloth inspection machines, it would be a great advantage to have a method for modifying the existing manually operated speed change control to automatic control at a reasonable price.

SUMMARY OF THE INVENTION

An object of the present invention is to provide a method of modifying existing manually controlled speed change cloth inspection machines to provide automatic control.

Another object of the present invention is to provide a cloth inspection station where the operator has access to the start-stop and reverse switches at any place along the inspection station.

A still further object of the present invention is to provide a drive control and drive system which substantially increases the longevity of the cloth inspection machine.

An even further object of the present invention is to provide an automatic drive system for a cloth inspection machine which minimizes the drag on the material.

These and other objects of the present invention are attained by replacing the transmission and variable ratio pulley and belt drive system of the existing cloth inspection machine with a fixed ratio pulley and belt system. The speed change of the motor is affectuated by a control system which is responsive to a tachometer which monitors the winding speed of the cloth by monitoring the rotational speed of the measuring drum. Using a single motor, an electrical clutch is used to interconnect the output of the single motor to the take-up mount and the supply mount. Whereas the start-stop switch would control the activation or deactivation of the motor, a reversing switch would control the electrical clutch to disconnect the take-up spool mount and drive the supply spool mount.

Alternatively, two motors may be used wherein the first motor will be responsive to the start-stop switches to drive the take-up reel mount and the second motor would be responsive to the reversing switch to drive the supply reel mount. To prevent loading of the supply spool mount, the armature of the reversing motor is open circuited while the forward motor is operating. The control circuit would include a switch to determine in which direction the single motor or the reverse motor will drive the supply spool mount. The reversing switch not only activates the controls for the reversing motor, but disconnects the control to the forward motor. In the two motor system, the output of the forward motor is connected to the take-up spool mount by two pairs of pulleys and two belts wherein one pulley from each pair is mounted to a common shaft. The common shaft is rotatively mounted and controlled by a reversing linkage which moves the common shaft sufficiently towards the take-up spool mount to slacken the belt and effectively disconnect the forward motor from the take-up spool mount. This reduces the loading of the take-up spool by the forward motor when the reversing motor is operating.

The speed of the measuring drum is measured by a tachometer which is connected thereto by pulley and belt. A limit switch is provided to detect that the material at the end of the roll is in the inspection station but not on the measuring drum. A circuit responsive to the limit switch substitutes a fixed input to the control system for the input from the tachometer such that the motor is run at a fixed speed to allow inspection of the last few yards of material.

Other objects, advantages and novel features of the present invention will become apparent from the following detailed description of the invention when considered in conjunction with the accompanying drawings.

DESCRIPTION OF THE PREFERRED EMBODIMENTS

Figure 1:
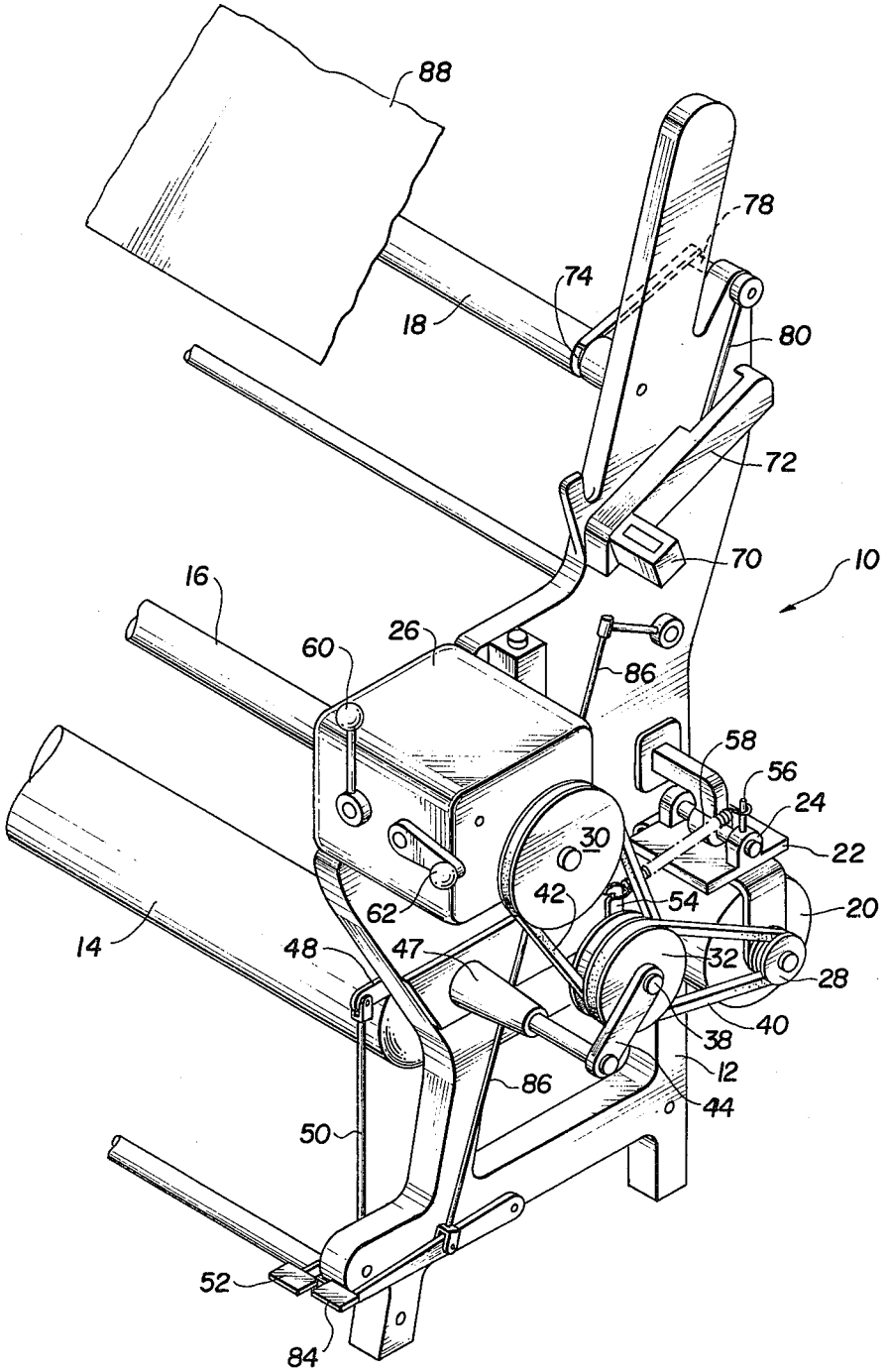
FIG. 1 PRIOR ART
FIG. 1 is a partial side perspective view of a cloth inspection machine of the prior art.
Figure 2:
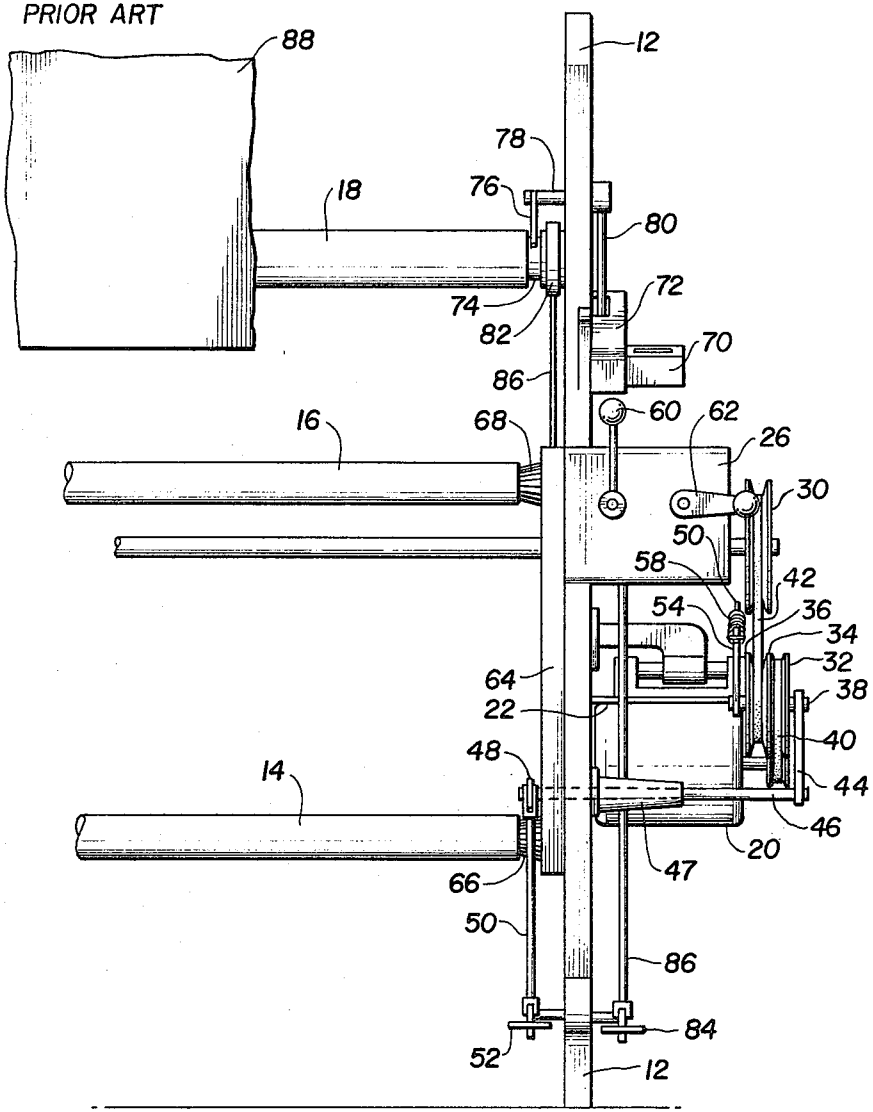
FIG. 2 PRIOR ART
FIG. 2 is a partial front view of the prior art cloth inspection machine of FIG. 1.

Before beginning a detailed explanation of the present invention, the prior art, manual, variable speed cloth inspection machine illustrated in FIGS. 1 and 2 will be described in detail. This will facilitate the understanding of the modification of this machine to incorporate the principles of the present invention. As discussed above it is more economical to modify these machines than to purchase totally new machines since the basic structure of the machine except for the drive has a substantially unlimited life. The cloth inspection station 10 as illustrated in FIGS. 1 and 2, includes a pair of frame members 12 having a supply spool 14, take-up spool 16 and measuring drum 18 extending therebetween. Other rollers and structural interconnecting members have been deleted for sake of clarity. The supply spool 14, the take-up spool 16 and the measuring drum 18 are important to the understanding of the present invention and therefore they are illustrated.

A drive motor 20 is mounted to a plate 22 which is pivotally mounted to the frame 12 at 24. A two-speed transmission 26 is also mounted to the frame and is interconnected to the motor 20 by a variable ratio pulley and belt drive system. Connected to the output shaft of motor 20 is a pulley 28 and connected to the input of the transmission 26 is a pulley 30. The interconnection of the motor pulley 28 and the transmission pulley 30 is provided through a plurality of pulleys 32, 34 and 36 mounted on a common shaft 38. The pulleys 32, 34 and 36 are conical pulleys with the middle pulley 34 moving axially along the common shaft 38. A belt 40 interconnects the motor output pulley 28 to pulleys 32 and 34 and a belt 42 interconnects the pulleys 34 and 36 to the input pulley 30 of the transmission 26. The shaft 38 is mounted to arm 44 which is mounted on the end of shaft 46. Shaft 46 is received within a bearing 47 in support 12. Mounted to the other end of shaft 46 is an arm 48 which is connected by a link 50 to a foot pedal 52 which is pivotally connected to the frame 12. Mounted to the opposite end of shaft 38 is an arm 54. Mounted to the top of motor plae 22 is an arm 56. Spring 58 interconnects the arms 54 and 56.

The operator of the machine by using foot pedal 52 may vary the ratio of the drive system between the motor 20 and the transmission 26. The pivotal motion of the foot pedal 52 is transmitted through link 50 and arm 48 to rotate shaft 46. Rotation of shaft 46 through arm 44 moves shaft 38 since pulley 30 is stationary. The motion of shaft 38 causes the belt 42 to ride up or down the conical face of pulley 36. As shaft 38 rotates to increase its distance from the transmission pulley 30, the belt 42 will bear down and force the center conical pulley 34 away from conical pulley 36 and towards conical pulley 32. This will cause the belt 42 to ride down the face towards the shaft 38 while belt 40 is being driven up the face of pulley 32 away from the shaft 38. The motor 20 which is pivotally mounted will rotate to compensate for rotation of the shaft 38. Thus it can be seen that the operator by moving foot pedal 52 can change the drive ratio between the motor 20 and the input of the transmission 26.

The transmission 26 has a control lever 60 and a speed control lever 62. The control lever 60 is used to determine whether the transmission 26 is in forward, reverse or neutral. Speed lever 62 changes the gear ratio of the transmission 26 between one of two speeds. The output of the transmission 26 is interconnected under guard 64 to the supply mount 66 and the take-up mount 68 to which the supply spool 14 and take-up spool 16 are respectively mounted. The operator can determine through control handle 60 whether the cloth is being driven forward for inspection via take-up spool mount 68 or is being driven in reverse via supply spool mount 66. Similarly the speed of the drive to the cloth inspection machine may be adjusted between two speeds by the speed lever 62 with other variations via the variable ratio pulley and belt drive system in connection with foot pedal 52.

It has been the experience in the industry that the operators will generally not operate the foot pedal 52 and consequently the linear speed of the cloth will vary with the diameter of the material during the inspection of a bolt. This is highly undesirable. Similarly it can be seen by using the conical pulleys which respond to the loading on the belts 40 and 42, these belts have a short life and must be frequently replaced.

The linear footage of the cloth being transmitted through the inspection machine is recorded on counter 70. The output of the measuring drum 18 is connected to the counter 70 through a drive under the cover 72. A recess 74 is provided in the measuring drum 18. A feeler 76, mounted to shaft 78 which is received through support 12, lies in the recess 74. The other end of shaft 78 includes an arm 80 which extends into the counter drive cover 72. The end of arm 80 is a measurement lock linkage and when the feeler 76 rides in the recess 74, the arm 80 will extend down into the cover 72 and lock the counter drive system between the measuring drum 18 and the counter 70. In use, the feeler 76 is retained above the recess 74 by the material which is traveling over the measuring drum 18. Since this is a well known element, the details of the transmission under cover 72 are not disclosed.

A brake 82 which is generally a leather strap is connected to a foot pedal 84 by linkage 86. When the drive is stopped or the control lever 62 is in neutral, the operator can brake the measuring drum 18 by the foot pedal 84 and the brake strap 82. A viewing support plate 88 is provided in the viewing area.

Now that the prior art cloth inspection machine of FIGS. 1 and 2 has been described, the adaptation of this machine to include the principles of the present invention will now be described in detail. The parts or elements which are not changed will have the same numbers in FIGS. 3 and 4 as they have in FIGS. 1 and 2. For certain applications, it is desirable to have separate forward and reverse motors so as to reduce loading of the non-driven spool mount during driving with the other spool mount. Thus FIGS. 3 and 4 will describe the use of a forward motor and a separate reversing motor. For other applications, the loading of the non-driven mount is not as critical and the cloth inspection machine may be modified using a single motor. This will be described in reference to FIG. 6.

The transmission 26 is removed and a plate 100 is mounted in its place using the mounting holes previously used to connect the transmission to the frame 12. The take-up spool mount 88 is replaced by take-up spool mount 102 which includes a shaft extending through a bearing assembly 104 in the plate 100. On the end of the take-up spool mount shaft is mounted a pulley 106. Similarly the supply spool mount 66 is replaced by a supply spool mount 108 having a shaft 110 extending through frame 12 and a pulley 112 is mounted to the other end of the shaft 110. The conical pulleys 32, 34 and 36 are removed from shaft 38 and are replaced by pulleys 114 and 116. A belt 118 interconnects the pulley 114 to a motor 115 and a belt 120 connects the pulley 116 to the take-up spool mount pulley 106. The forward motor 115 is mounted to plate 117 which is pivotally mounted at 119 to the rear of frame 12. Thus the variable pulley and drive belt system of the original device is replaced by a fixed ratio pulley and belt drive system interconnecting the forward drive motor 115 and the take-up spool mount 102. Also mounted to the original shaft 46 and shaft 38 is an additional arm 122. Mounted to shaft 112 is an extended arm 124. It should be noted that although the shaft 46, arm 44 and shaft 38 of the original device may be used, these elements may be replaced by a single unit preassembled.

The extended arm 124 is connected by a rod 126 to an arm 128. A shaft 130 is supported in floor mounted assemblies 132 and has the arm 128 mounted to one end thereof. Mounted to the other end of shaft 130 is an extended foot pedal 134. The length of the shaft 130 is selected such that the foot pedal 134 is substantially in the center of the viewing area. Foot pedal 134, shaft 130, arms 124 and 128, and rod 126 all form part of the reversing system. By placing the foot pedal 134 substantially in the middle of the viewing area, the operator may conveniently reverse the direction of the cloth being inspected without being tied down to the right side of the machine as in prior art devices. Also included in the reversing system is a limit switch 136 having a cable 138 connecting it to the control system. The limit switch 136 is mounted to the frame 12 adjacent to the arm 124.

Figure 3:
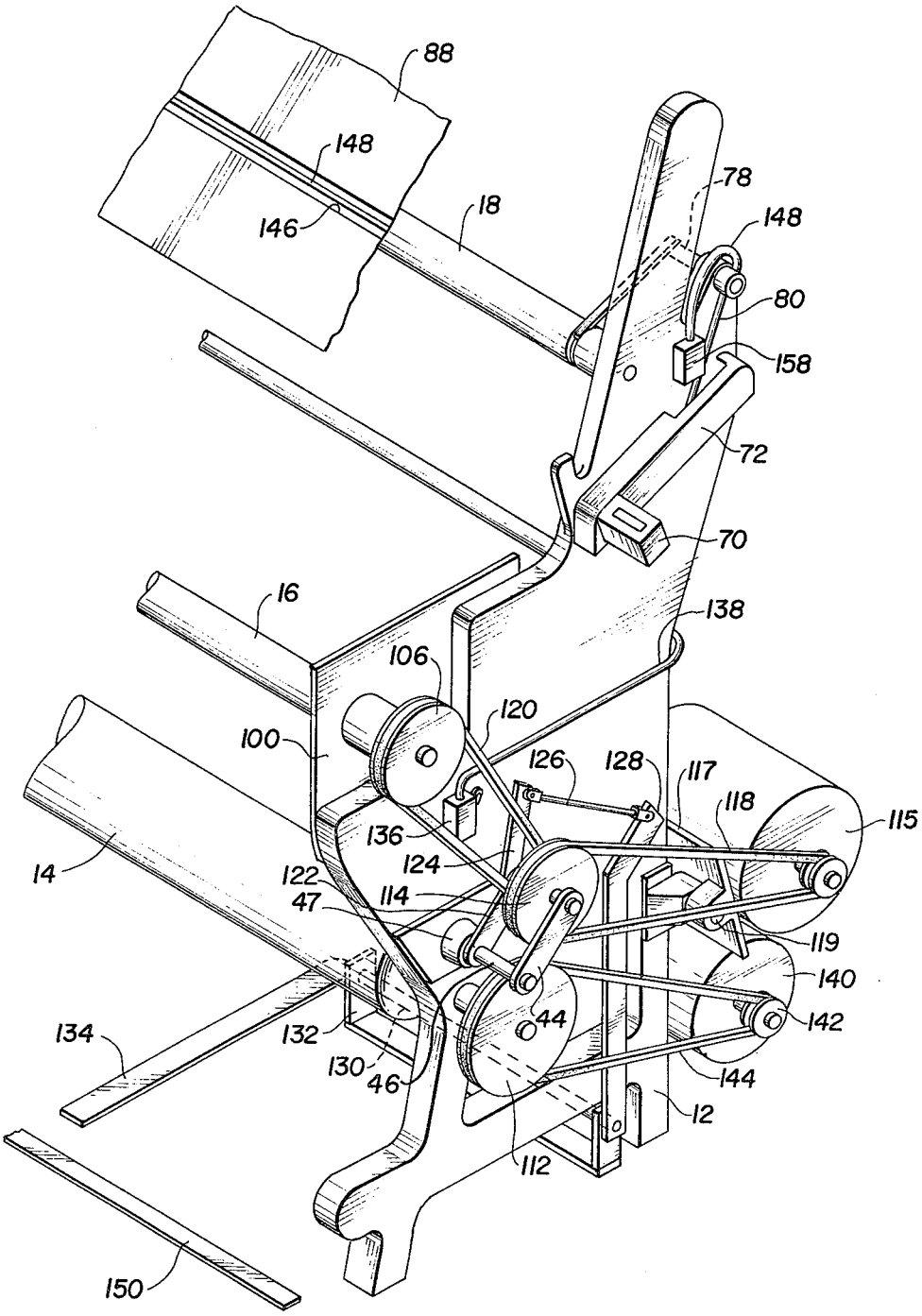
FIG. 3 is a partial side perspective view of a cloth inspection machine according to the principles of the present invention.

When the operator desires to reverse the direction of the fabric, pedal 134 is depressed which rotates through shaft 130, and arm 128 counter-clockwise in FIG. 3. This motion is transmitted through rod 126 to arm 124 which causes arms 122 and 44 to rotate counter-clockwise about the axis of shaft 46. With sufficient rotation, the belt 120 becomes sufficiently flexed that the take-up spool mount pulley 106 is effectively disconnected from pulley 116. With the pivotal mount of motor 115, it will rotate following the rotation of the axis of pulley 114. By disconnecting the pulley and belt system from the take-up spool mount pulley 106, the take-up spool mount is unloaded and thus will not produce drag on the reverse winding of the material in the inspection station.

Adjacent to the path of arm 124 is limit switch 136. As arm 124 rotates counter-clockwise in FIG. 3, it activates limit switch 136 which sends a signal to the control system to activate reversing motor 140 which is mounted to the frame 12. A pulley 142 on the output of reversing motor 140 is connected by a belt 144 to the pulley 112 connected to the supply spool mount 108. As long as the pedal 134 is depressed, arm 124 keeps limit switch 136 activated so as to drive the reversing motor 140. When it is desired to stop the reversing, pedal 134 is released which causes the opposite rotation of the reversing system and deactivated switch 136. The control system responsive to switch 136 deenergizes reversing motor 140.

An additional feature of the present invention is the placement of the start and stop switch at a position convenient for the operator such that the operator can stand in the center of the viewing area. A recess 146 is provided in the viewing support plate 88 and a pressure sensitive strip switch 148 is inserted in the recess 146. Similarly, on the floor, a pressure sensitive strip stop switch 150 is provided. This allows the operator to move along the axis of the viewing area and have complete access to the start and stop controls. The start and stop switches 148 and 150 provide input signals to the control system for the forward motor 115.

Figure 5:
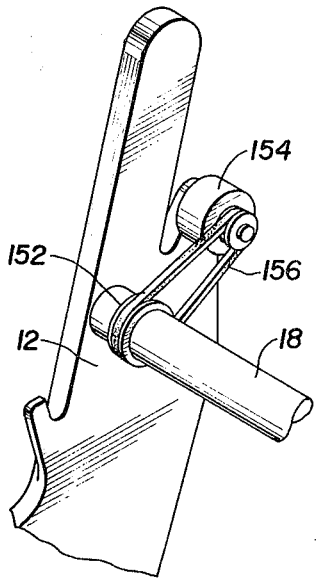
FIG. 5 is a partial perspective of the tachometer and measuring drum interconnection.

Referring to FIG. 5, the end of the measuring drum 18 is modified to include a pulley 152. A tachometer 154 is mounted to the frame 12 and is interconnected to the pulley 152 of the measuring drum 18 by belt 156. As will be explained more fully in reference to the schematic of FIG. 6, the output of the tachometer which is a function of the linear speed of the cloth is used to control the forward motor 115.

Figure 4:
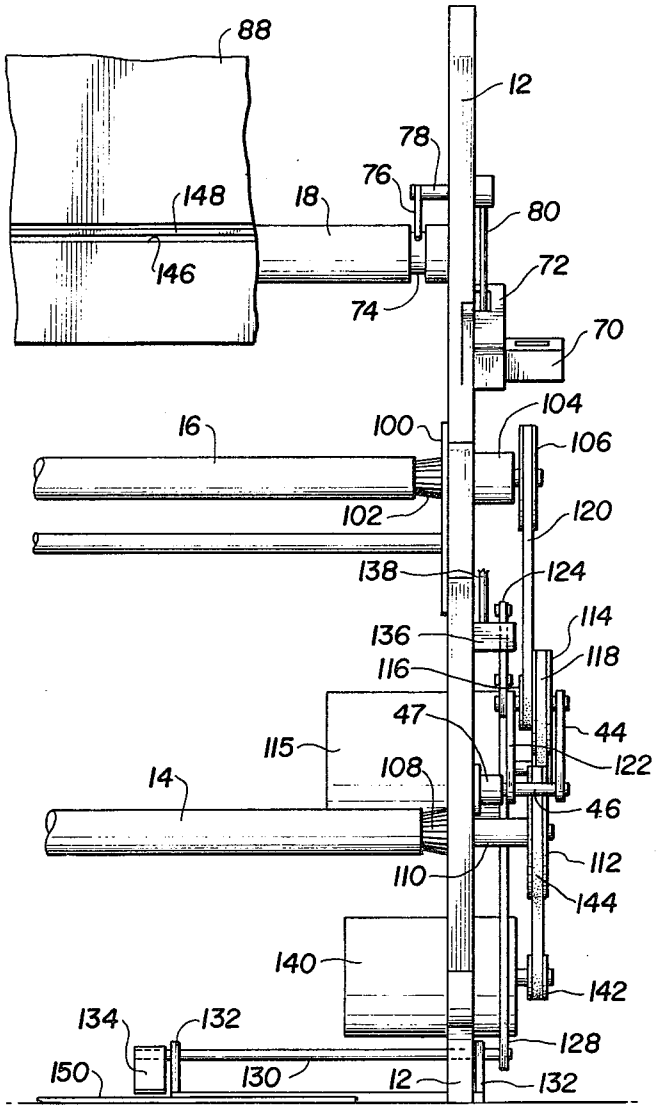
FIG. 4 is a front view of the cloth inspection machine of FIG. 3 according to the principles of the present invention.

Close to the end of the roll, a couple yards of fabric will still remain to be inspected even though it will not drive the measuring drum 18. Since measuring drum 18 will not rotate, the tachometer 154 will provide a false signal to the control system for the forward motor 115. Thus a limit switch 158, as illustrated in FIGS. 3 and 4, is provided adjacent to the arm 80 of the measurement lock linkage to detect when there is no more material on the measuring drum 18. A signal is provided to the control system which provides a fixed signal to the forward motor 115 instead of the false signal from the tachometer 154.

Figure 6:
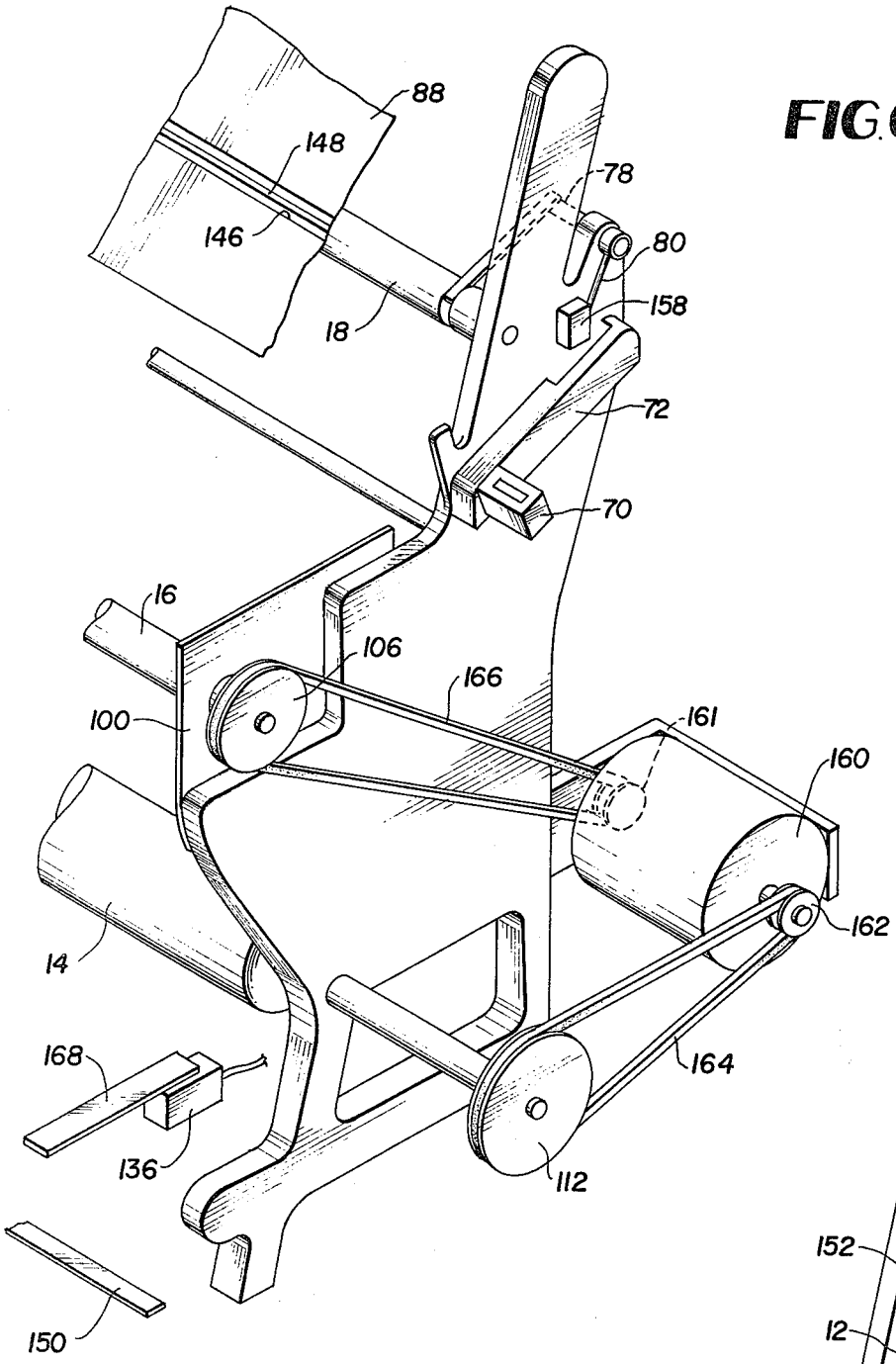
FIG. 6 is a partial side perspective view of another embodiment of a cloth inspection machine according to the principles of the present invention using a single motor.

Before describing the schematic of FIG. 7 for the two motor embodiment of FIGS. 3 and 4, the single motor embodiment of FIG. 6 will be described. A single motor 115 (not shown) may be provided and mounted to the frame 12 and include an electrical clutch 160. A pulley 162 on one output of the electrical clutch 160 is connected by belt 164 to the supply spool mount pulley 112. A pulley 161 on the other output of the electrical clutch 160 is connected by belt 166 to the take-up spool mount pulley 106. Thus a single motor with an electrical clutch provides a simple fixed ratio belt and pulley drive system. The reversing system of FIG. 6 includes merely a pedal 168 connected to the limit switch 136 which provides the control for reversing which is affectuated through the electrical clutch 160. Depending upon the speed of the motor, the pulleys and the desired speed of the spools, a speed reducer (not shown) may be provided between the output of the motor and the electrical clutch 160.

Figure 7:
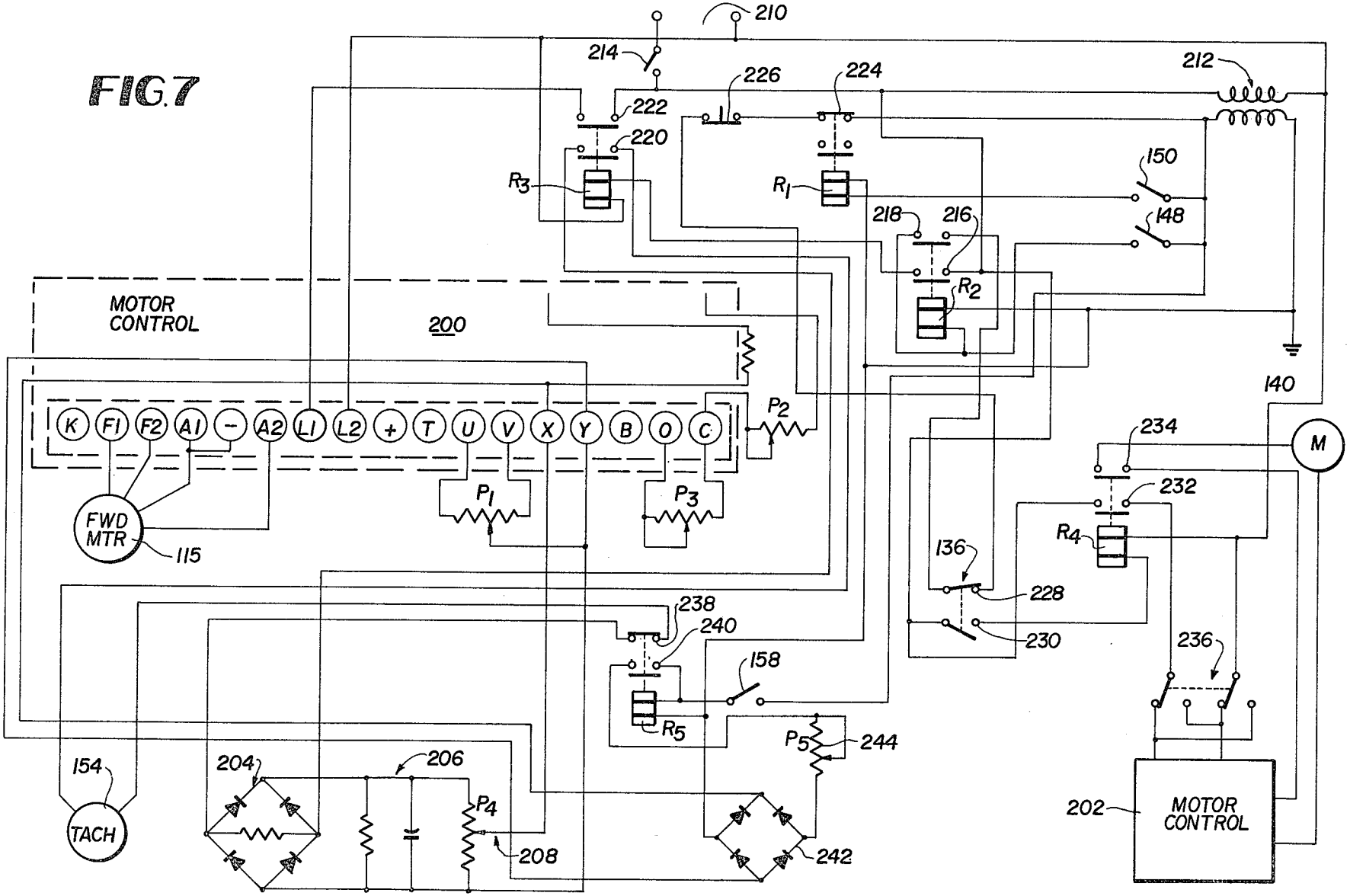
FIG. 7 is schematic incorporating the principles of the present invention for the cloth inspection machine of FIGS. 3 and 4.

Referring to the schematic of FIG. 7 for the dual motor system of FIGS. 3 and 4, the switches and motors from FIGS. 2 and 3 have the same numbers as they do in those figures. The forward motor 115 is connected to a motor control circuit 200 and the reversing motor 140 is connected to a motor control circuit 202. The motor control 200 may be a model JCO-75 available from T. B. Woods' Son Company, Chambersburg, PA. The motor control 202 may be a Model E-50 from the same company. Motor control 200 varies the speed of the forward motor 115 based upon the input to terminals X and Y. Motor control 202 drives reversing motor at a fixed speed. Variable resistor P1 connected to terminals U and V varies the speed setting of the motor control circuit 200 whereas variable resistors P2 and P3 connected to terminals O and C vary the torque of the motor. The tachometer 154 is connected to the X,Y terminals through a full-wave rectifier 204, a filter 206 and a variable resistor bridge 208. In addition to filtering, filter 206 also provides a load on the tachometer 154. Preferably tachometer 154 is an AC tachometer.

The power input at 210 includes one line connected directly to the motor control 200, step down transformer 212 and the motor control 202. The other power line is connected to the remainder of the system through a main power switch 214. Connected across one side of step down transformer 212 is a series circuit of the start switch 148 and relay R2. A second series circuit connected across one side of transformer 212 is a series circuit of the stop switch 150 and relay R1. Activation of start switch 148 energized relay R2 which closes the normally opened contacts 216 and 218. The pair of contacts 218 lock on the relay R2 allowing the start switch 148 to be released. The contacts 216 complete a circuit across the power source 210 to activate relay R3. Once activated, relay R3 closes the two pairs of normally open contacts 220 and 222. The contacts 220 interconnects the tachometer 154 to the full-wave rectifier 204. The contacts 222 provide the other power line to the motor control 200. Thus momentary activation of start switch 148 provides power to the motor control 200 as well as connecting the tachometer 154 to the motor control 200.

Closing stop switch 150, which is normally opened, activates relay R1 which opens the normally closed pair of contacts 224. This will break the circuit between one side of the transformer 212 through normally closed emergency stop switch 226 and normally closed contacts 228 of the reversing limit switch 136. This breaks the holding circuit for the start relay R2. Deactivation of the holding circuit and deactivation of R2 will deactivate R3 and disconnect the power from the motor control 200. Thus, it should be noted that the forward motor 115 may be stopped by activation of the stop switch 150 or activation of the emergency stop switch 226 or activation of the reversing limit switch 136.

As an improvement over prior art devices, the motor control 200 will dynamically brake the forward motor 115. This will prevent the material from continuing to roll on after the stop switch is initiated. In prior art devices, this roll on wraps the defective area onto the roll and, thus, will prevent the area of the cloth to be marked unless the system is reversed. The dynamic breaking will reduce the amount of reversing of the system.

A reversing relay R4 is connected to the power lines through a second set of contacts 230 of reversing limit switch 136. Reversing relay R4 closes two normally closed pairs of contacts 232 and 234. The contacts 232 provides power to the motor control 202 and contacts 234 provide a closed circuit between the output of the motor control 202 and the armature of the reversing motor 140. By providing a second pair of contacts 234, the armature of the reversing motor 140 is disconnected during a normal operation of the inspection station and thus reversing motor 140 will not load the supply spool. This is especially true if reversing motor 140 has a permanent magnetic field since it would then act as a generator and provide drag on the system. The contacts 232 of the reversing relay R4 are connected to the control 202 by a switch 236. The switch 236 supplies power to the motor control 202 in a first polarity or a second reverse polarity. This allows the motor 140 to be driven in either of two rotational directions. This is important since the material supplied may be wound on the supply roll in opposite directions. Thus during rewinding the supply mount must be rotated in the appropriate direction to rewind the material. Irrespective of how the material is wound on the supply spool, the take-up roll is always driven in the same direction and thus therefore this feature is not needed on the forward motor 115.

The end of roll switch 158 activates a relay R5. The relay R5 has two pairs of contacts, the first being a normally closed pair 238 and the second being a normally opened pair 240. Upon activation of the end of roll switch 158, relay R5 is energized opening the normally closed contacts 238. These contacts are in series with the tachometer 154 and the full wave rectifier 204. This removes the output from the tachometer 154 as an input to the motor control 200. The closing of the second pair of contacts 240 of relay R5 connects the power across full wave rectifier 242 and adjustable resistor 244. This provides an input to the X,Y terminals of the motor control 200 to drive the forward motor 115 at a fixed speed irrespective of the speed of the measuring drum 18.

The basic schematic of FIG. 7 is designed for the two-motor system of FIGS. 3 and 4. As the mechanical drive was simplified by using a single motor as illustrated in FIG. 6 also the schematic of FIG. 7 would be simplified for a single motor. The single motor can be driven by a single motor control 200 and would eliminate the motor control 202. The circuit would be modified to include a control of the electrical clutch depending upon activation of the reversing switch 136. Modification of FIG. 7 for the single motor is well within the skill of the art. Studies have shown that the optimum view linear speed of the cloth should be within 15 to 20 yards per minute depending upon the width of the cloth. Since the cloth speed in an uncontrolled inspection machine will vary between 10 to 45 yards per minute from the beginning to the end of the roll, a majority of the material is being viewed at more than optimum speed. Also, the manually adjustable speed system of FIGS. 1 and 2 has not in practice provided the required speed control. A test conducted showed that the error rate of defects missed using the machine of FIGS. 1 and 2 was two defects per hundred linear yards whereas with the machine of FIGS. 3 and 4, the rate was 0.6 defects per hundred linear yards. Thus a controlled viewing rate is important.

From the preceding description of the preferred embodiments, it is evident that the objects of the invention are obtained in that a method wherein preexisting manual, variable ratio drive cloth inspection machines may be modified to become automatic fixed ratio drive systems. Although specific motor controls have been used, obviously other types of motor controls may be utilized. Similarly since the adaptation was shown using a specific cloth inspection station, it is not to be so limited. The overall process may be used to modify the variable ratio drive systems for both inspection machines. Although the invention has been described and illustrated in detail, it is to be cleary understood that the same is by way of illustration and example only and is not to be taken by way of limitation. The spirit and scope of the invention are to be limited only by the terms of the appended claims.

What I claim is:

1. In a cloth inspection machine having a supply mount from which cloth may be drawn, a take-up mount about which said cloth may be wound and accumulated, a cloth viewing area between said supply and take-up mounts, drive means for rotating said take-up mount to wind and accumulate said cloth thereon including a motor and means for changing the speed of said drive means, the improvement being said speed change means comprising:

means for sensing the speed of said cloth at said viewing area when it is being inspected;

control means responsive to said sensing means output for varying directly the speed of said motor to maintain a substantially constant linear speed of said cloth as it passes through said viewing area;

said drive means including a fixed ratio drive system interconnecting said motor and said take-up mount;

a rotatable measuring drum positioned between said supply mount and said take-up mount;

means connected to said measuring drum for detecting that said sensing means cannot monitor the speed of the end of the cloth after the end of the cloth has moved past said measuring drum and yet is not completely accumulated on said take-up mount and out of the viewing area; and means responsive to said detecting means for substituting a fixed input to said control means for the input from said sensing means.

2. The cloth inspection machine according to claim 1, wherein said sensing means includes a tachometer for measuring the speed of said measuring drum to monitor the speed of said cloth.

3. The cloth inspection machine according to claim 1 including a start switch and a stop switch connected to said control means and said control means dynamically brakes said motor in response to activation of said stop switch.

4. The cloth inspection machine according to claim 3 wherein said machine includes a viewing support plate; said start switch is on said plate; and both of said start and said stop switches are comprised of means enabling them to be activated at a plurality of locations.

5. The cloth inspection machine according to claim 1 including a supply mount drive means for rotating said supply mount and a cloth direction reversing means which energizes and activates said supply mount drive means when activated.

6. The cloth inspection machine according to claim 5 wherein said supply mount drive means includes a second motor and a second control means for running said second motor at a fixed speed when said reversing means is activated.

7. The cloth inspection machine according to claim 6 wherein said take-up mount drive means includes means interconnecting said take-up mount motor and said take-up mount, said reversing means de-energizes said take-up mount control means and includes means for disabling said take-up mount drive interconnecting means when activated.

8. The cloth inspection machine according to claim 6 wherein said reversing means opens the circuit to the armature of said second motor when deactivated.

9. A cloth inspection machine comprising:

a supply mount;

a take-up mount about which cloth may be accumulated;

a cloth viewing area between said supply mount and said take-up mounts;

a take-up motor;

fixed ratio drive means interconnecting said take-up motor and said take-up mount;

means for sensing the linear speed of the cloth when it is being inspected;

a viewing support plate;

a start switch on said viewing support plate and a stop switch;

control means responsive to said sensing means and said start and stop switches for directly varying the speed of the take-up motor to maintain the cloth at a substantially constant linear speed in response to said start switch and said monitoring means and dynamically brake said motor in response to said stop switch;

means for detecting that said sensong means cannot monitor the speed of the end of the cloth after the end of the cloth has moved past said sensing means and yet is not completely wound about said take-up mount and out of the viewing area; and means responsive to said detecting means for substituting a fixed input to said control means for the input from said sensing means.

10. A cloth inspection machine according to claim 9 wherein said machine includes a cloth engaging measuring drum positioned between said supply mount and said take-up mount and said sensing means includes a tachometer for measuring the speed of said measuring drum to monitor the speed of said cloth.

11. A cloth inspection machine according to claim 10 including a pulley on said measuring drum, a pulley on said tachometer and a belt interconnecting said pulleys.

12. The cloth inspection machine according to claim 9 wherein said fixed ratio drive system includes flexible belt interconnecting means.

13. The cloth inspection machine according to claim 12 wherein a first belt engaging pulley is mounted on said take-up mount and a second belt engaging pulley is mounted on the output of said take-up motor.

14. The cloth inspection machine according to claim 13 wherein intermediate belt engaging pulley means are positioned between said first and second pulleys.

15. The cloth inspection machine according to claim 9 wherein said start switch is comprised of a pressure sensitive strip which enables it to be activated at a plurality of discrete locations on said viewing plate.

16. In a cloth inspection machine having a supply mount, a take-up mount, a cloth viewing area between said supply and take-up mounts, drive means for rotating said take-up mount including a motor means for changing the speed of said drive means, the improvement comprising:

said speed change means including means for sensing the speed of the cloth being inspected and control means responsive to said sensing means output for varying the speed of said motor to maintain a substantially constant linear speed of said cloth;

including a drive means for rotating said supply mount and a reversing means for energizing said supply mount drive means wherein said supply mount drive means includes a second motor and a second control means for running said second motor at a fixed speed when said reversing means is activated;

said take-up mount drive means including means for interconnecting said take-up mount motor and said take-up mount and wherein said interconnecting means includes a first pulley on the output of said take-up mount motor, a second pulley on said take-up mount, a third and fourth pulley on a common shaft, a belt between said first and fourth pulleys, a belt between said second and third pulleys, said common shaft being mounted to move relative to said take-up mount; and said reversing means including a disabling means connected to said common shaft to move the axis of said common shaft relative to said take-up mount to slacken the belt between said second and third pulley to effectively disconnect said take-up motor from said take-up mount when said reversing means is activated.

* * * * *

UNITED STATES PATENT AND TRADEMARK OFFICE

CERTIFICATE OF CORRECTION

PATENT NO. : 4,422,223

DATED : December 27, 1983

INVENTOR(S) : Robert L. Haines

It is certified that error appears in the above—identified patent and that said Letters Patent is hereby corrected as shown below:

Column 1, line 28, after "kept" insert --within--.

Column 3, line 67, change "plae" to --plate--.

Column 7, line 34, change "energized" to --energizes--.

Column 9, line 9, change "both" to --cloth--.

Signed and Sealed this

Twenty-fourth Day of July 1984

[SEAL]

*Attest:*

GERALD J. MOSSINGHOFF

*Attesting Officer*

*Commissioner of Patents and Trademarks*